US010775744B2

(12) United States Patent
Gilomen et al.

(10) Patent No.: US 10,775,744 B2
(45) **Date of Patent: *Sep. 15, 2020**

(54) TIMEPIECE COMPRISING A DAY/NIGHT DISPLAY THAT TAKES ACCOUNT OF SEASONAL VARIATIONS

(71) Applicant: The Swatch Group Research and Development Ltd, Marin (CH)

(72) Inventors: Beat Gilomen, Grenchen (CH); Dominique Lechot, Les Reussilles (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/835,497

(22) Filed: Dec. 8, 2017

(65) Prior Publication Data

US 2018/0181074 A1 Jun. 28, 2018

(30) Foreign Application Priority Data

Dec. 23, 2016 (EP) ..... 16206863
Oct. 11, 2017 (EP) ..... 17195835

(51) Int. Cl.
*G04B 19/26* (2006.01)
*G04B 19/22* (2006.01)

(52) U.S. Cl.
CPC ..... *G04B 19/262* (2013.01); *G04B 19/226* (2013.01)

(58) Field of Classification Search
CPC ..... G04B 19/226; G04B 19/26; G04B 19/262
See application file for complete search history.

(56) References Cited

U.S. PATENT DOCUMENTS 1,997,511 A * 4/1935 Canepa ..... G04B 19/268 368/18
5,132,943 A * 7/1992 Davies ..... G04B 19/226 368/21
5,383,165 A * 1/1995 Vaucher ..... G04B 19/25 368/185
2002/0131329 A1* 9/2002 Ochoa Loaiza ..... G04B 19/226 368/23
2012/0243381 A1* 9/2012 Goeller ..... G04B 19/25 368/34
2012/0243388 A1* 9/2012 Goeller ..... G04B 13/003 368/169
2014/0126336 A1* 5/2014 Goeller ..... G04B 19/268 368/15
2015/0234357 A1* 8/2015 Willemin ..... G04B 19/262 368/17
2016/0098012 A1* 4/2016 Gilomen ..... G04B 19/26 368/17

* cited by examiner

*Primary Examiner* — Daniel P Wicklund
(74) *Attorney, Agent, or Firm* — Oblon, McClelland, Maier & Neustadt, L.L.P.

(57) ABSTRACT

A timepiece includes a timepiece movement, a calendar mechanism and a mechanism for indicating the sunrise and sunset that take account of seasonal variations. The calendar mechanism includes a date display and a month display. The sunrise and sunset indicating mechanism also includes an annual cam having a profile representative of the tilt of the sun with respect to the equatorial plane and arranged to be driven in rotation by the date wheel set via a third kinematic chain.

17 Claims, 5 Drawing Sheets

TIMEPIECE COMPRISING A DAY/NIGHT DISPLAY THAT TAKES ACCOUNT OF SEASONAL VARIATIONS

This application claims priority from European Patent Applications No. 16206863.9 filed on Dec. 23, 2016 and Ser. No. 17/195,835.8 filed on Oct. 11, 2017, the entire disclosure of which is hereby incorporated herein by reference.

FIELD OF THE INVENTION

The present invention concerns a timepiece comprising a timepiece movement and sunrise and sunset indicating means that take account of seasonal variations, said means comprising a sphere that replicates the terrestrial globe, a support, and a ring mounted on the support and arranged concentrically to the sphere, the ring being arranged to indicate the position of the earth's terminator, and the ring and the sphere being arranged to be able to rotate with respect to each other, at a rate of one revolution in 24 hours, about a first axis corresponding to the polar axis of the terrestrial globe, and to be able to pivot with respect to each other about a second axis intersecting the first axis perpendicularly at the centre of the sphere, the ring being mounted to pivot on the support about the second axis, the sunrise and sunset indicating means further comprising an annual cam that has a profile representative of the tilt of the sun with respect to the equatorial plane, and is arranged to be driven in rotation at a rate of one revolution per year, a cam follower arranged to cooperate with the cam, and a kinematic chain arranged to connect the cam follower to the ring, such that the plane subtended by the ring forms with the first axis an angle equal to the relative angle of tilt of the sun with respect to the equatorial plane.

PRIOR ART

The duration of the day is the time comprised, each day, from the moment when the upper limb of the sun appears above the horizon in the east, at sunrise, until it disappears below the horizon in the west, at sunset. Whatever the time, there is always one half of the earth's surface which is illuminated by the sun, and another half which is in darkness. The earth's terminator is the line of demarcation between the portion of the earth which is illuminated and that which is in darkness. Geometrically speaking, the earth's terminator is a large circle which encircles the earth. This large circle extends in a plane perpendicular to the plane of the earth's orbit around the sun (called the ecliptic plane). It is also noted that the centre of the earth is on the line of intersection between these two planes.

Generally, the length of day varies throughout the year and also depends on latitude. This variation is caused by the tilt of the axis of rotation of the earth on itself with respect to the ecliptic plane. This tilt by definition corresponds to the latitude of the tropics which is ±23° 27'. As is well known, the length of day is shortest at the December Solstice in the Northern Hemisphere, and at the June Solstice in the Southern Hemisphere. At the equinoxes, the length of day and night are equal everywhere on earth.

There are already known timepieces arranged to indicate the current position of the boundary between day and night and which meet the definition given in the above preamble. Descriptions are found, in particular, in European Patent documents EP2911013, EP2977832 and EP3007012 in the name of the Applicant. However, the use and the design of these timepieces present a certain number of difficulties.

In particular, the ring and the terrestrial globe are arranged to be driven by the movement in order to rotate with respect to one another, at a rate of one revolution in 24 hours, so as to provide an indication of the current position of the earth's terminator on the surface of the globe. In this regard, it will be understood that, since the hour wheel of a timepiece normally completes one revolution in 12 hours, it may advantageously serve as the driving element for this rotation. This simply requires combining the hour wheel with, for example, a reduction gear having a ratio equal to 1:2. However, one problem with such a configuration is that, when the hands of the timepiece are acted on to change from summer time to winter time, for example, the indication of the current position of the earth's terminator on the globe is moved, although this does not reflect an actual movement of the sun in the sky.

BRIEF SUMMARY OF THE INVENTION

It is an object of the present invention to overcome the aforementioned drawbacks of the prior art. The invention achieves this object by providing a timepiece movement.

According to the invention, the timepiece movement comprises a manually actuatable time change mechanism arranged to pivot the hour wheel set, step-by-step, independently of the motion work. Those skilled in the art will understand that one advantage of such a correction mechanism is that it makes it possible to change time zones or switch between summer time and winter time, without affecting the indication of the minutes and the indication of the seconds by the timepiece.

According to the invention, the timepiece movement also comprises, on the one hand, a second kinematic chain which connects the hour wheel set to the ring or to the sphere, so as to drive the ring or the sphere such that one rotates with respect to the other at a rate of one revolution in 24 hours, and comprises, on the other hand, a disengagement mechanism arranged to disengage the second kinematic chain when the time change mechanism is implemented to pivot the hour wheel set to change from summer time to winter time, or vice versa. One advantage of such an arrangement is that the rotation of the ring or of the sphere, with respect to one another, at a rate of one revolution in 24 hours, is not affected by any summer time/winter time correction.

Also according to the invention, the timepiece comprises a calendar mechanism comprising means for displaying the date, arranged to be driven via the hour wheel set, and a month display arranged to be driven by the means for displaying the date. Further, the annual cam is arranged to be driven via the means for displaying the date. One advantage of this design is that, after an indeterminate period of stoppage of the timepiece, the annual cam can automatically be returned to the correct position without any possible error, simply by resetting the date of the calendar mechanism.

According to the invention, the date display means are driven by the hour wheel set. In these conditions, when the wearer of the timepiece pivots the hour wheel set, step-by-step, forwards or backwards, with the aid of the time change mechanism, the hour correction automatically results in correction of the calendar mechanism.

According to an advantageous variant of the invention, the timepiece movement comprises a first hour wheel meshing with the motion work and referred to as the 'motion-work hour wheel', and a second hour wheel, referred to as the 'hour-wheel', which forms part of the hour wheel set. Further, the time change mechanism comprises a coupling and indexing device which is disengageable and which is arranged to alternatively disengage and make integral in rotation the first and second hour wheels.

BRIEF DESCRIPTION OF THE DRAWINGS

Other features and advantages of the invention will appear upon reading the following description, given purely by way of non-limiting example, with reference to the annexed drawings, in which.

DETAILED DESCRIPTION OF EMBODIMENTS

Figure 1:
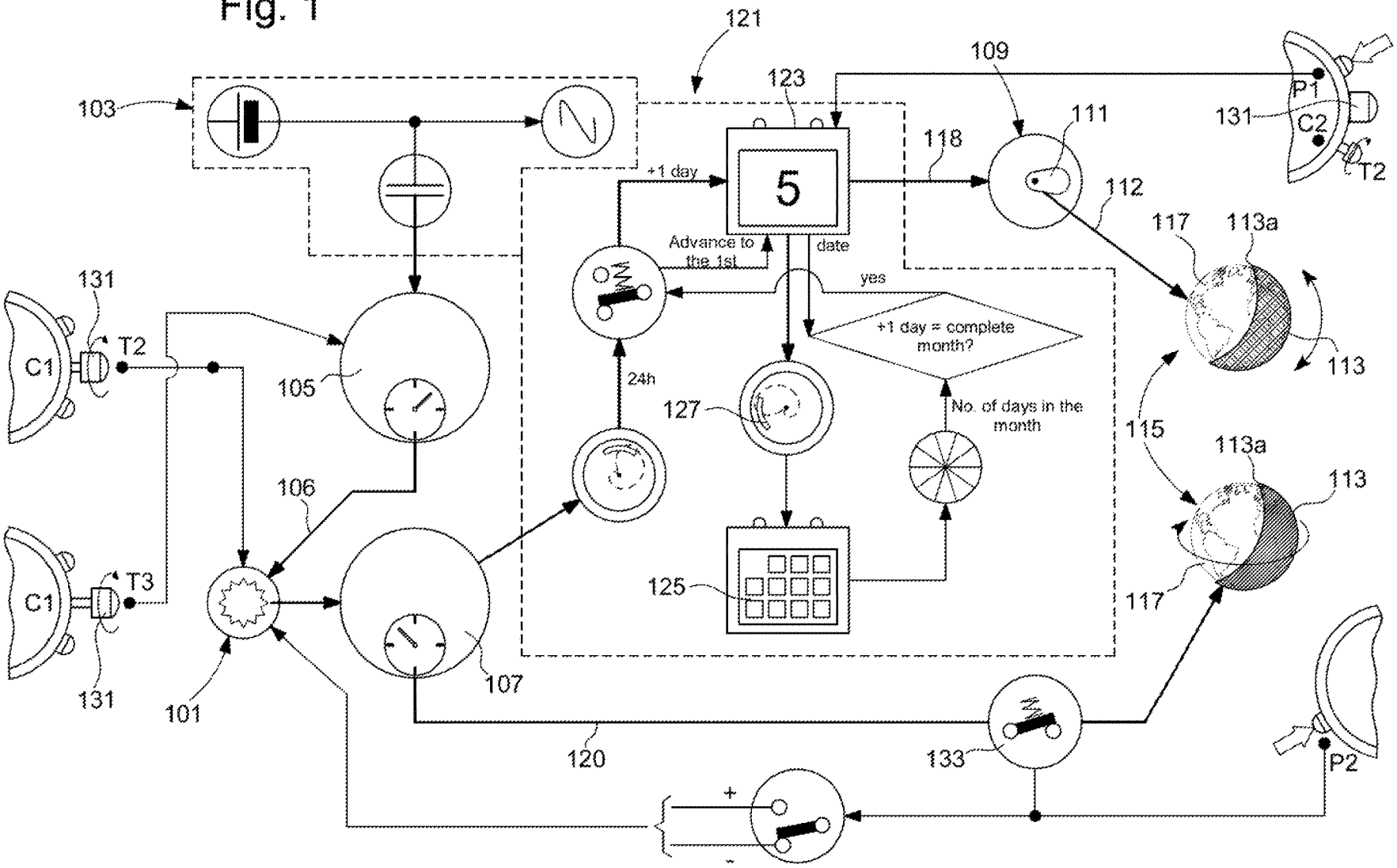
FIG. 1 is a block diagram briefly illustrating the kinematic connections between different mechanisms of a timepiece according to a first particular embodiment of the invention.

FIG. 1 annexed is a block diagram illustrating the kinematic connections associating different mechanisms of a timepiece according to a first exemplary embodiment of the invention. This extremely basic block diagram represents the means for transmitting the driving force provided by the movement to the various mechanisms with the aid of double-thickness arrows, and represents the kinematic connections which are arranged to transmit the commands manually inputted by a user with the aid of thinner arrows.

In the block diagram of FIG. 1, the arrows symbolise kinematic connections which, between them, connect symbols that represent different mechanisms of the timepiece. The mechanisms represented by the symbols are a drive mechanism 103 that combines a drive member, a regulating member and an escapement, a minute wheel set (referenced 105) which is integral with a minute display member and which is arranged to be driven at a rate of one revolution per hour by the drive mechanism, an hour wheel set 107 integral in rotation with an hour display member, a motion work 106 connecting the minute wheel set to the hour wheel set, such that the latter is driven at the rate of one revolution every 12 hours, and a time change mechanism (referenced 101) inserted between motion work 106 and hour wheel set 107. In the illustrated example, the hour wheel set is arranged to make one complete revolution every 12 hours. It will be understood, however, that according to the invention, the hour wheel set could alternatively be arranged to rotate at a rate of one revolution every 24 hours.

Still referring to FIG. 1, it can be seen that the illustrated timepiece further comprises a calendar mechanism 121 which comprises, in particular, means for displaying the date 123, arranged to be driven via hour wheel set 107, and a month display 125 arranged to be driven by the date display means via monthly drive means (referenced 127 in FIG. 1). According to the first embodiment forming the subject of the present description, the date display means 123 comprise a date wheel (not shown), and monthly drive means 127 are arranged to increment month display 125 each time that the date wheel passes from the position corresponding to the last day of the month to that corresponding to the first day of the following month. Calendar mechanism 121 of the present description is preferably a perpetual calendar or an annual calendar mechanism. It should be recalled that, as is well known to those skilled in the art, a perpetual calendar mechanism is a mechanism that automatically takes account of the different lengths of the months and leap years, and that, unlike the perpetual calendar, the annual calendar does not take account of February, which is considered to be a month of 30 days, or leap years. The annual calendar mechanism therefore has to be manually corrected once a year, at the end of February. Since perpetual calendar and annual calendar mechanisms are well known to those skilled in the art, the operation of calendar mechanism 121 will not be described in detail. It is further specified that the invention is not limited to timepieces comprising a perpetual or annual calendar mechanism. The calendar mechanism could also be of a different type.

According to the invention, the illustrated timepiece also comprises means for indicating the sunrise and sunset that take account of seasonal variations. These means comprise a sphere replicating the terrestrial globe, a support, and a ring mounted on the support concentrically to the sphere and arranged to indicate the position of the earth's terminator. The ring and the sphere are arranged to be driven in order to rotate with respect to one another, at a rate of one revolution in 24 hours, about a first axis corresponding to the polar axis of the terrestrial globe. Further, the ring is mounted on the support in order also to be able to pivot relative to the sphere about a second axis intersecting the first axis perpendicularly at the centre of the sphere. The sunrise and sunset indicating means further comprise an annual cam having a profile representative of the relative tilt of the Sun with respect to the equatorial plane and arranged to be driven in rotation at the rate of one revolution per year, a cam follower arranged to cooperate with the cam, and a first kinematic chain arranged to connect the cam follower to the ring, such that the plane subtended by the ring forms, with the first axis, an angle equal to the tilt angle of the Sun with respect to the equatorial plane. Referring to FIG. 1, it can be seen that, in the embodiment represented, the timepiece comprises a sunrise and/or sunset indicating mechanism which comprises a sphere 117 representing the terrestrial globe and a half-spherical shell 113, which is arranged concentrically to sphere 117 so as to darken or conceal one half of the terrestrial globe. Shell 113 has a substantially circular rim 113*a*, and it will be understood that this rim forms said ring of the sunrise and sunset indicating means according to the invention. Still referring to FIG. 1, it can also be seen that the annual cam is referenced 111 and that it forms part of a tilt control mechanism (generally referenced 109). It will be understood that the cam follower (not represented) also forms part of the tilt control mechanism.

According to the invention, the date display means 123 are arranged to drive annual cam 111 via a third kinematic chain 118. As already mentioned, date display means 123 of the present example comprise a date wheel (not represented), and third kinematic chain 118 takes the form of a reduction gear train arranged downstream of the date wheel and having a gear ratio of 1:12. In the present example, the reduction gear train comprises a 16-tooth pinion integral with the date wheel, a 48-tooth wheel meshing with the 16-tooth pinion and integral with a 14-tooth intermediate pinion, which in turn meshes with a 56-tooth wheel integral with annual cam 111 (the wheels and pinions are not illustrated in the diagram of FIG. 1). The annual cam is thus arranged to make one revolution while the date wheel makes twelve revolutions. It will thus be understood that annual cam 111 and calendar mechanism 121 are arranged to advance synchronously.

According to the embodiment of the invention illustrated in FIG. 1, the movement of half-spherical shell 113 relative to sphere 117 is the result of the combination of distinct rotations about two perpendicular axes that intersect at the centre of the sphere. The first of these two rotations is made by sphere 117, which is arranged to rotate at the rate of one revolution in 24 hours about the first of these two axes, and the other rotation corresponds to the pivoting of the half-spherical shell representing the dark 113 (dark half sphere) about the second axis and manifests as a variation in the angle of tilt of the half-sphere with respect to the first axis. Since the movements of dark half-sphere 113 and of sphere 117 with respect to one another are two functionally independent movements, sunrise and/or sunset indicating mechanism 115 is represented twice in FIG. 1. Referring to the Figure, it will be understood that mechanism 115 is represented once to depict the rotation of sphere 117 at the rate of one revolution in 24 hours about the first axis, and a second time to depict the pivoting of dark half-sphere 113 about the second axis.

According to the invention, the pivoting motion about the second axis is controlled using annual cam 111, whose profile is representative of the tilt of the sun above or below the equatorial plane. The cam follower (not represented) is arranged to transmit the variations in the cam profile to half-spherical shell 113 through a first kinematic chain 112. According to the first embodiment of the invention, dark half-sphere 113 is mounted to pivot on a fixed support and the arrangement of indicator mechanism 115, like that of first kinematic chain 112, may conform, for example, to the description given in European Patent document EP 2911013. This document is incorporated by reference in the present description.

Figure 4A:
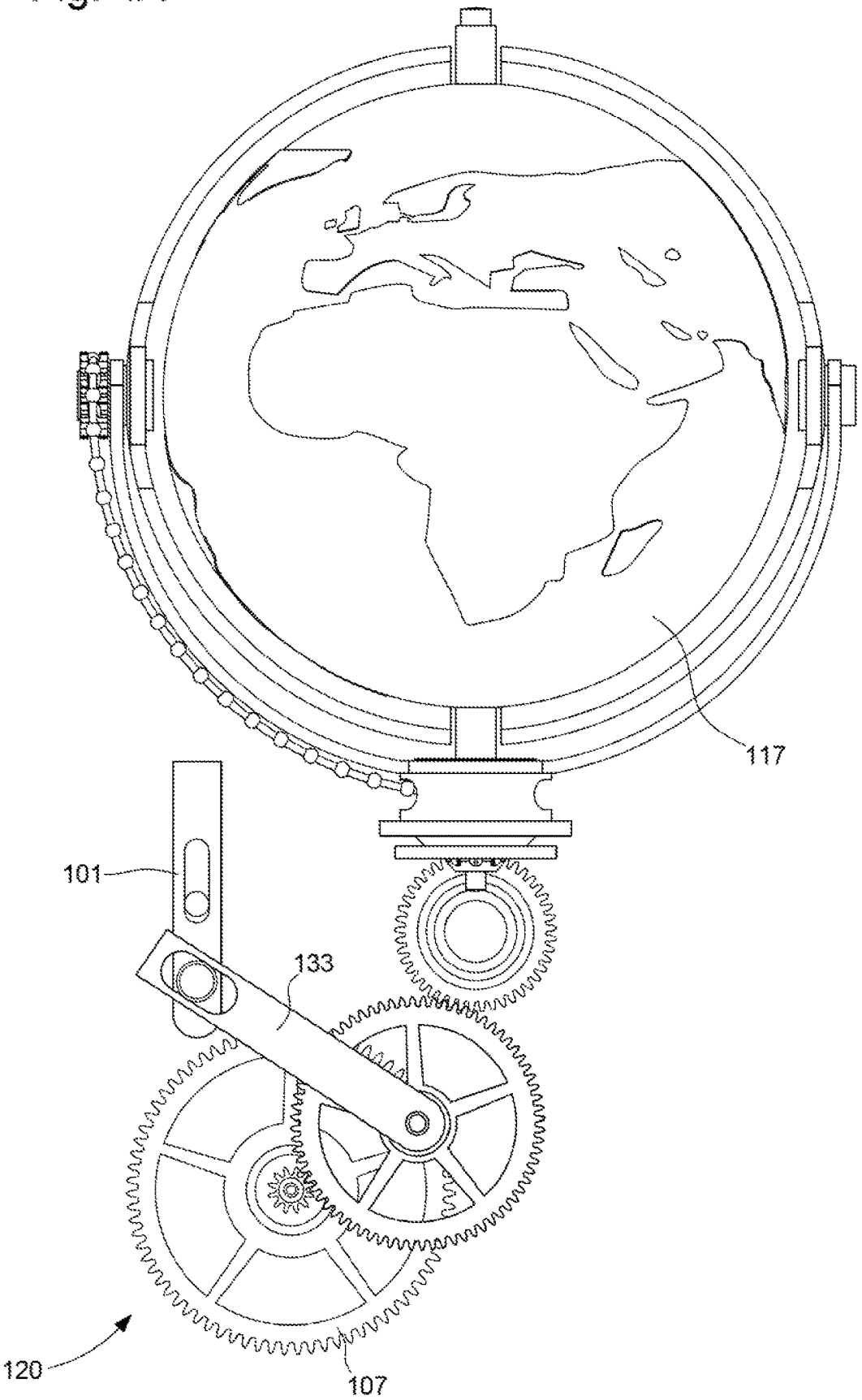
FIGS. 4*a* and 4*b* are views of structural elements of the timepiece.

According to the present embodiment of the invention, hour wheel set 107 is connected to sphere 117 by a kinematic chain 120 (hereinafter 'second kinematic chain 120'). The second kinematic chain is arranged to drive the sphere in rotation so that it rotates about a first axis corresponding to the polar axis of the terrestrial globe, at the speed of one revolution in 24 hours. FIG. 1 also shows a disengagement mechanism 133 arranged to disengage on demand second kinematic chain 120. See also FIGS. 4A and 4B.

Referring again to FIG. 1, it can be seen that the timepiece whose operation is represented also comprises a certain number of corrector mechanisms which are arranged to be manually actuated by the wearer of the timepiece. First of all, as already mentioned, a time change mechanism (referenced 101) is inserted between motion work 106 and hour wheel set 107. As will now be explained, mechanism 101 can be controlled in two different ways depending upon whether the time change relates to an actual change of longitude, following a journey for example, or relates to the change from winter time to summer time, or vice versa. In the illustrated example, when the wearer of the timepiece changes time zone during a trip, he can correct the time indication by means of control stem 131 of the timepiece. In order to do this, he must pull stem 131 out into position T2 before rotating the crown to move the hour hand forwards or backwards in a series of one-hour jumps. As was seen above, hour wheel set 107 drives calendar mechanism 121 and annual cam 111. Further, hour wheel set 107 also drives sphere 117 in its rotation about the first axis. It will thus be understood that annual cam 111, calendar mechanism 121 and sunrise and/or sunset indicating mechanism 115, are arranged to advance synchronously, not only when they are driven by means of drive mechanism 103, but also when they are manually driven forwards or backwards by means of control stem 131 in position T2.

Figure 4B:
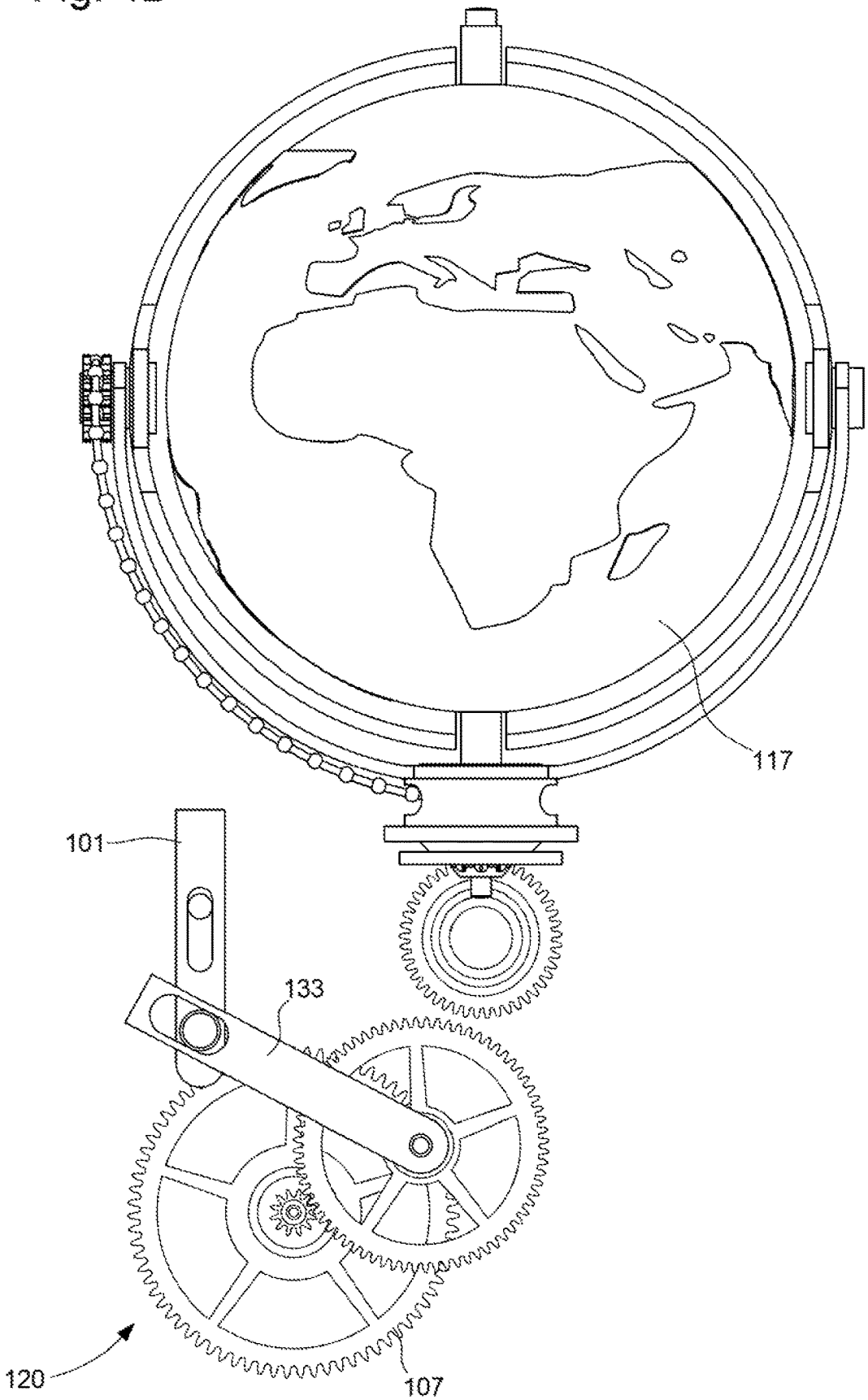

In the illustrated example, at the change from winter time to summer time or from summer time to winter time, the wearer of the timepiece can move the time indication exactly one hour forward or back by pressing on pusher P2. Pressing on pusher P2 not only actuates time change mechanism 101, but also simultaneously actuates disengagement mechanism 133, so as to disengage second kinematic chain 120, as shown in FIG. 4B. It will be understood that disengaging the second kinematic chain at the change from summer time to winter time, or vice versa, prevents the movement of the hour hand affecting the relative angular position of dark half-sphere 113 with respect to sphere 117.

In addition to time change mechanism 101, the timepiece of the present example comprises a conventional type of time-setting mechanism. This time-setting mechanism allows the wearer of the timepiece to set the time by using control stem 131. In order to do this, he must move stem 131 into position T3 before rotating the crown. As in most current timepieces, the time-setting mechanism is arranged to drive motion work 106, which in turn drives minute wheel set 105 and hour wheel set 107. As was the case previously with the correction of the time zone, hour wheel set 107 drives calendar mechanism 121 and annual cam 111 via third kinematic chain 118. Further, hour wheel set 107 also drives sphere 117 in its rotation about the first axis. It will thus be understood that annual cam 111, calendar mechanism 121 and sunrise and/or sunset indicating mechanism 115, are arranged to advance synchronously, also when they are driven manually forwards or backwards by means of control stem 131 in position T3.

Finally, the calendar mechanism of the timepiece of the present embodiment also comprises a mechanism for correcting month display 125 of calendar mechanism 121. When the wearer of the timepiece wishes to correct the month indication, for example following an indeterminate period of stoppage of the timepiece, he can advance the month indication step-by-step by actuating pusher P1. According to the present example, actuation of pusher P1 by the timepiece wearer has the effect of driving date wheel 123 in rotation at high speed. The correction mechanism is arranged such that a single press on the pusher is sufficient to advance the date wheel one complete revolution if required. However, a movable stop, also comprised in the correction mechanism, has the function of stopping the date wheel as soon as the latter reaches the angular position corresponding to the indication of the first day of the month, after passing the 31st day of the month. On passing from the last day of the month to the first day of the following month, the date wheel actuates monthly drive means 127, which has the effect of incrementing month display 125. It will thus be understood that this month display correction mechanism has the advantage of allowing the link between the date and the month to be retained during the correction. The correction mechanism that has just been explained is known as such. It is described in European Patent publication EP2503410 entitled "Calendar mechanism comprising a quick month corrector". This document is incorporated by reference in the present patent application.

As already explained, the date display means 123 are arranged to drive annual cam 111 via a third kinematic chain 118. Further, according to the first embodiment, third kinematic chain 118 takes the form of a reduction gear train arranged downstream of the date wheel and having a gear ratio of 1:12. In these conditions, it will be understood that, since the month correction is combined with a quick advance of the date, the month display correction mechanism simultaneously corrects the angular position of annual cam 111.

Figure 2:
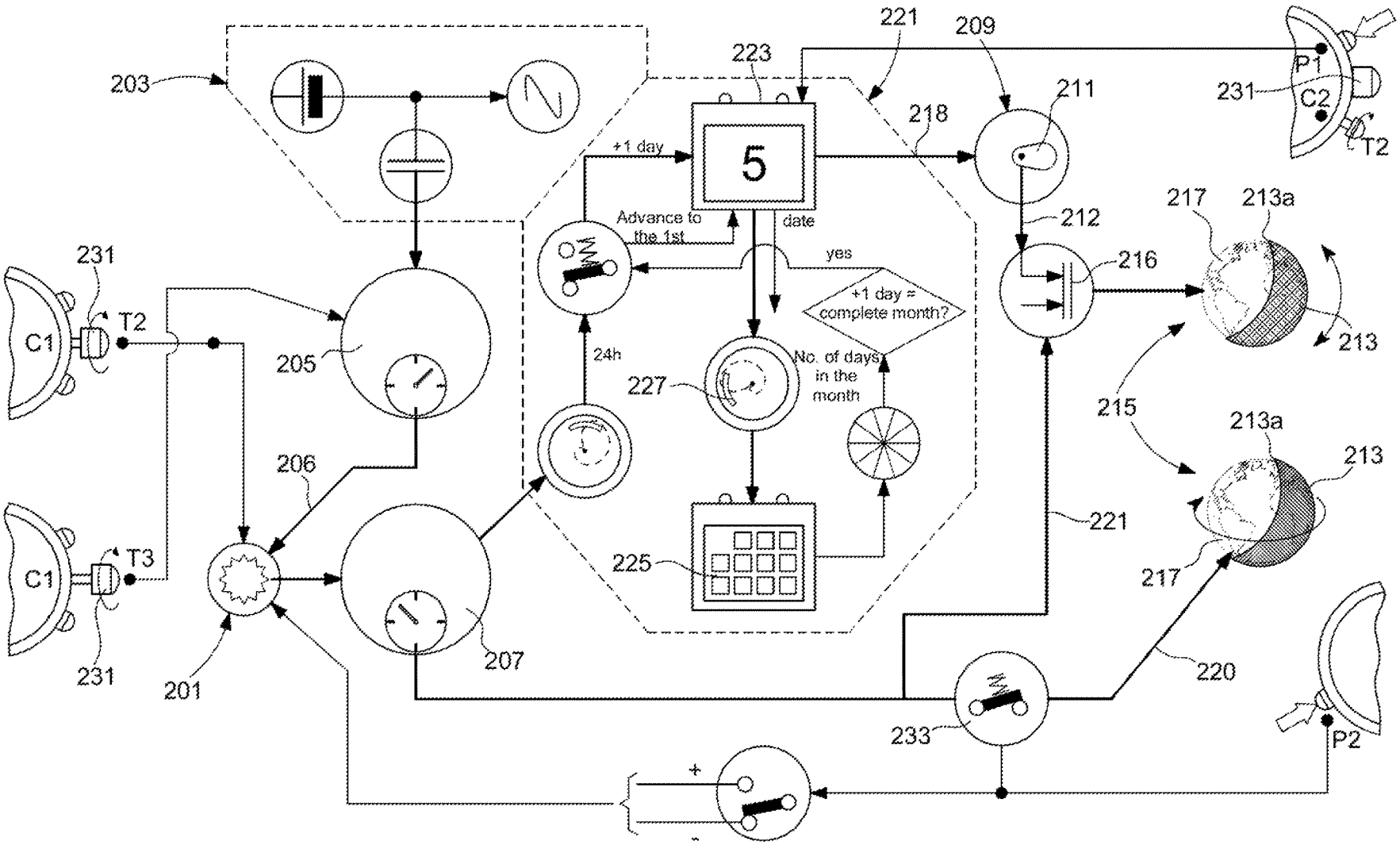
FIG. 2 is a block diagram briefly illustrating the kinematic connections between different mechanisms of a timepiece according to a second particular embodiment of the invention.

FIG. 2 annexed is a very similar block diagram to that of FIG. 1, but illustrating the kinematic connections associating different mechanism of a timepiece according to a second exemplary embodiment of the invention. As will be seen, the second embodiment is very similar to the first and, in particular, both the calendar mechanism and the correction mechanisms arranged to be actuated by the wearer of the timepiece are identical to those which were described in relation to the first embodiment. FIG. 2 represents a drive mechanism 203 that combines a drive member, a regulating member and an escapement, a minute wheel set (referenced 205) which is integral with a minute display member and which is arranged to be driven at the rate of one revolution per hour by the drive mechanism, an hour wheel set 207 integral in rotation with an hour display member, a motion work 206 connecting the minute wheel set to the hour wheel set, such that the latter is driven at the rate of one revolution every 12 hours, and a time change mechanism (referenced 201) inserted between motion work 206 and hour wheel set 207, a tilt control mechanism (referenced 209) which comprises an annual cam 211 and a cam follower (not represented), and finally a sunrise and/or sunset indicating mechanism (referenced 215) comprising a sphere 217 that replicates the terrestrial globe and a half-spherical shell 213, which is arranged concentrically to the sphere.

FIG. 2 also shows a calendar mechanism 221 which comprises, in particular, means for displaying the date 223, arranged to be driven via hour wheel set 207, and a month display 225 arranged to be driven by the date display means via monthly drive means (referenced 227). According to the second embodiment forming the subject of the present description, the date display means 223 comprise a date wheel (not shown), and monthly drive means 227 are arranged to increment month display 225 each time that the date wheel passes from the position corresponding to the last day of the month to that corresponding to the first day of the following month. As was the previously the case with regard to the first embodiment, calendar mechanism 221 of the timepiece according to the second embodiment is preferably a perpetual calendar or annual calendar mechanism. Further, according to the invention, date display mechanism 223 is arranged to drive annual cam 211 via a third kinematic chain 218. In the illustrated example, the third kinematic chain could be identical to kinematic chain 118 described above in relation to the first exemplary embodiment.

In the second embodiment, as in the first, the relative movement of half-sphere 213 and sphere 217 is the result of the combination of distinct rotations about two perpendicular axes that intersect at the centre of the sphere. However, according to the second embodiment, it is dark half-sphere 213 which simultaneously makes the two rotations, since sphere 217 is not driven. This operating mode is made possible by the fact that the support (not represented), on which dark half-sphere 213 is mounted, is a rotating support. Still referring to FIG. 2, it will be understood that in the illustrated embodiment, hour wheel set 207 is connected to the rotating support (not represented) by a kinematic chain 220 (hereinafter 'second kinematic chain 220'). The arrangement of indicator mechanism 215 and that of second kinematic chain 220 could, for example, conform to the description in one or other of European Patent documents EP2977832 and EP3007012. These two documents are incorporated by reference in the present description.

Referring again to FIG. 2, it can be seen that a reference mechanism 216 is inserted between tilt control mechanism 209 and indicator mechanism 215. It can be seen that mechanism 216 comprises an output connected to indicator mechanism 215, and two inputs. A kinematic connection 221 (referred to as the 'fourth kinematic chain' 221) connects hour wheel set 207 to the first of the two inputs. Mechanism 216 is thus driven by the hour wheel set through its first input, called the 'driving input'. It can also be seen that the cam follower (not represented) is connected to the second input by a kinematic chain 212 (referred to as the 'first kinematic chain' 212) arranged to transmit the variations in the cam profile. Mechanism 216 is thus controlled by the profile of cam 211 through its second input, called the 'control input'. Just like second kinematic chain 220, the output of mechanism 216 is arranged to drive indicator mechanism at a speed of one revolution in 24 hours. However, mechanism 216 drives the indicator mechanism with an offset with respect to second kinematic chain 220. Mechanism 216 can be realized in many ways without departing from the scope of the present invention. It may, for example, be a differential mechanism, especially a differential mechanism as described in European Patent No EP 2977832. It may also be a disengagement mechanism, especially a disengagement mechanism as described in European Patent No EP3007012.

Figure 3A:
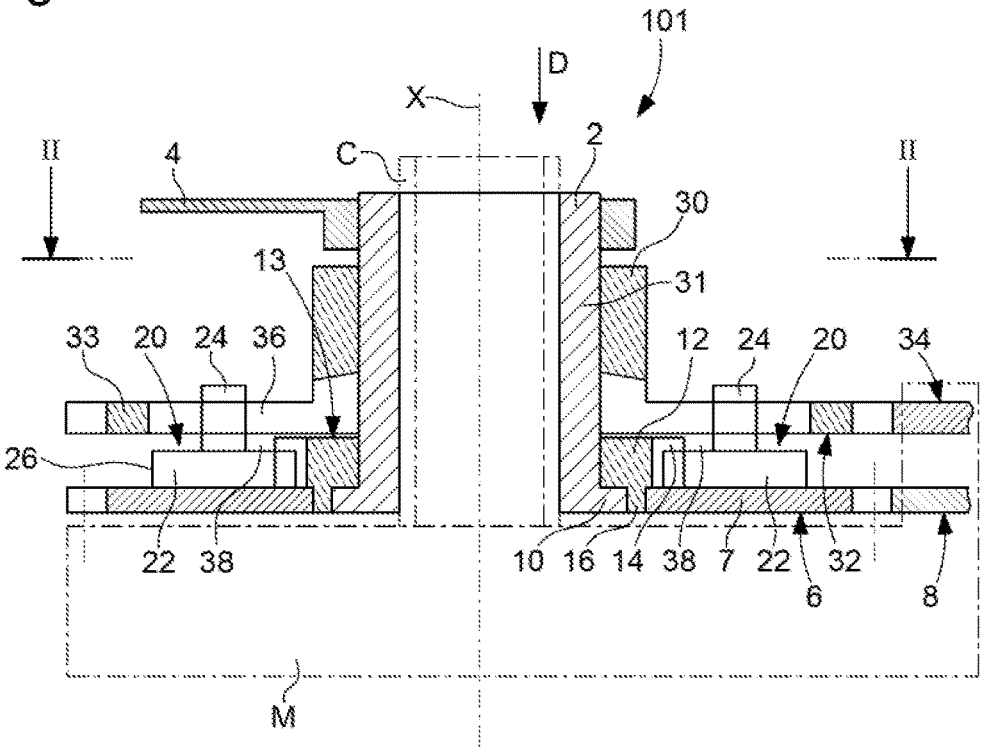
FIGS. 3A and 3B are respectively a cross-sectional view and a view of an example mechanism, known as such, which comprises a first and a second hour wheel and a disengageable coupling device arranged to make integral in rotation and index, or alternatively to disengage, the two hour wheels.
Figure 3B:
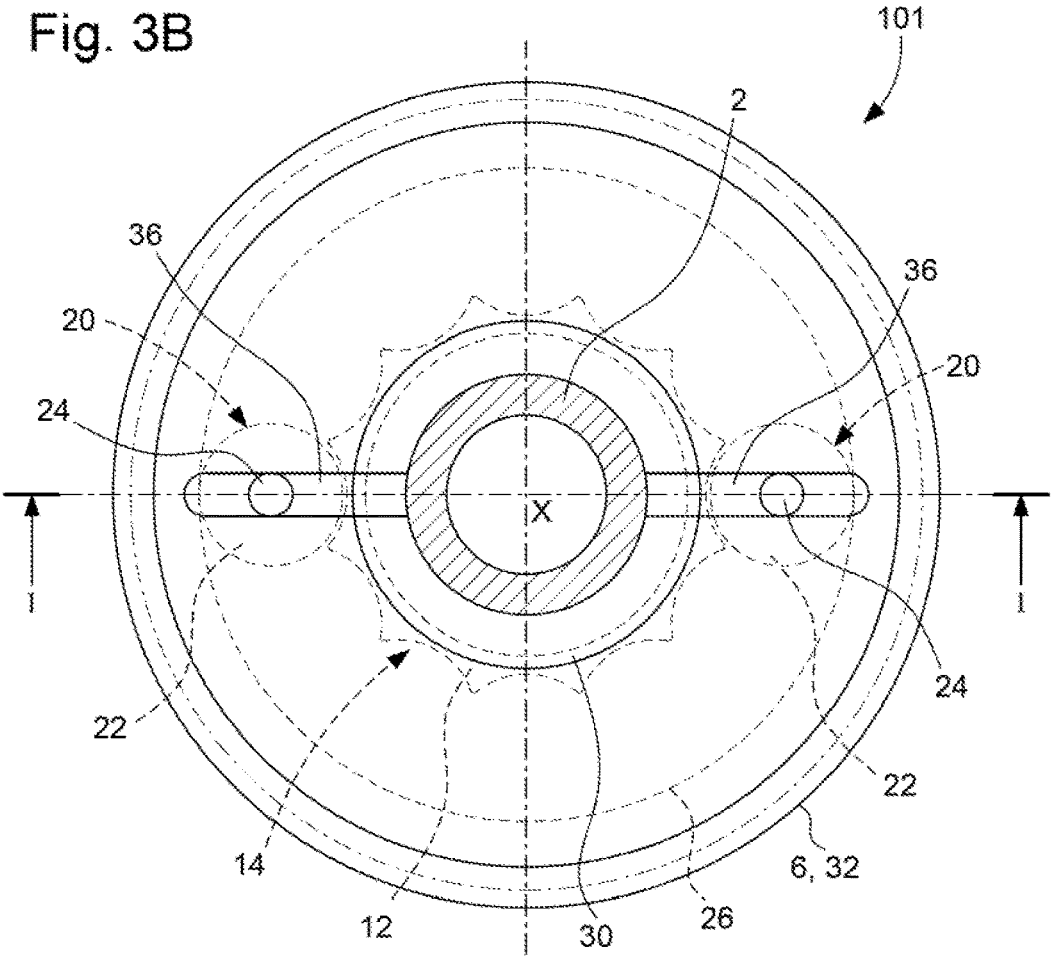

Referring now to FIGS. 3A and 3B, the time change mechanism, which is generally designated by the reference 101, will now be described in more detail. It will be recalled that mechanism 101 was already represented in FIG. 1, inserted between motion work 106 and hour wheel set 107. Moreover, mechanism 201 represented in FIG. 2 could be identical to mechanism 101. Mechanism 101 comprises a first pipe 2, called the inner pipe, intended to be mounted in rotation in a conventional manner, about an axis of rotation X, on a cannon-pinion C driven by drive mechanism 103 (shown in FIG. 1). Inner pipe 2 bears an indicator hand 4 forming the hour hand, which is externally pressed onto a free end of pipe 2 projecting from mechanism 101.

Inner pipe 2 thus forms an hour pipe, and it carries a first externally toothed wheel 6, called the lower wheel, comprising a plate 7. It will be specified here that, advantageously, this lower wheel 6 forms an hour wheel, and it meshes with a wheel 8 (partially represented) of motion work 106 (FIG. 1). In normal operation, this hour wheel 6 receives time information delivered by wheel 8 of the motion work, which information it transmits, as will be seen below, indirectly to inner hour pipe 2 and to indicator hand 4. Indeed, lower hour wheel 6 is mounted for free rotation on hour pipe 2. For this purpose, the end of hour pipe 2, opposite to the free end thereof carrying hand 4, comprises a collar 10 forming a shoulder freely supporting a star-wheel 12 on which wheel 6 is fixedly held. Star-wheel 12 comprises a plate 13, an external toothing 14 and a circular flange 16 arranged edgewise adjacent to toothing 14, behind and coaxially with the latter, underneath plate 13.

Hour wheel 6 is fixedly held on the side of star-wheel 12 against its toothing 14. Indeed, hour wheel 6 is force fitted externally onto flange 16, pressed and/or riveted thereon, via the central part of its plate 7 which has a bore opening. Star-wheel 12 and hour wheel 6 are thus directly integral in rotation and, in this example, as a result of their assembly, form a single piece placed on hour pipe 2. Star-wheel 12 and hour wheel 6 can thus be moved together concomitantly via wheel 8 of the motion work.

The time change mechanism also comprises two drive rollers 20 which are stepped and which each have a cylindrical base 22 from which a stud 24 extends in a perpendicular manner. The rollers are both engaged at rest, via their base 22, in toothing 14 of star-wheel 12 and they rest freely and sideways via this base against the side (unreferenced) of plate 7 of hour wheel 6. This rest position is also represented in a top view in FIG. 2B. Rollers 20 are also resiliently held in this rest position in toothing 14, by elastic return means 26, which are formed here by a closed annular spring, mounted coaxially to star-wheel 12 and acting radially on the outer periphery of bases 22 of rollers 20. It will be noted here that spring 26 is freely mounted against drive rollers 20, without any fixed attachment to mechanism 1. Spring 26 also rests freely against, and more particularly on, plate 7 of hour wheel 6. Spring 26 is thus self-supported and self-centering.

The time change mechanism further comprises a second pipe 30, called the outer pipe, which comprises a guide bore 31 and which is mounted externally via this bore 31 onto first pipe 2. This second pipe 30 carries a second externally toothed wheel 32 arranged above lower hour wheel 6 and called the 'upper wheel'. It will be specified here that the upper and lower positions of wheels 6 and 32 refer to the drawing of FIG. 3A, which represents the correction mechanism with the hour hands oriented upwards. Upper wheel 32 comprises a plate 33 and it meshes via its outer toothing with a wheel 34, driven in turn by a corrector member, which is manually actuatable from outside the timepiece.

Upper wheel 34 thus forms a time change wheel which, as will become clear, can directly correct the position of hour pipe 2 and of indicator hand 4, without acting on the motion work, and therefore without disrupting the other time information, such as the minutes and seconds, which are normally kinematically connected to hour pipe 2 via said motion work. Advantageously, outer pipe 30 is force fitted externally onto inner hour pipe 2 and it is thus secured thereto. These two pipes are therefore integral in rotation and they can be moved together. It will be understood that hour pipe 2, outer pipe 30 and upper wheel 34 together form hour wheel set 107. Upper correction wheel 34 can thus act on inner hour pipe 2 via outer pipe 30.

It will be specified that hour pipe 2 is also driven in normal operation by motion work 106, and in particular by wheel 8 of the motion work. This is why there are radial grooves 36 arranged in plate 33 of correction wheel 32, in which are freely engaged studs 24, which can translate radially in said grooves. Rollers 20 can thus drive in rotation correction wheel 32, and the two pipes 2 and 30, when star-wheel 12 is itself driven by hour wheel 6.

In order to change to another time zone, the user of the timepiece must rotate correction wheel 34; rollers 20 are then angularly displaced and jump (while star-wheel 12 and hour wheel 6 remain stationary) in toothing 14 of star-wheel 12, making spring 26 oval. Rollers 20 then return to the rest position in toothing 14 of star-wheel 12, but are offset with respect to the position of FIG. 3B. Hand 4 then indicates another time zone. It will be specified that, although the toothing of star-wheel 12 has 12 teeth in the Figures (to indicate the 12 hours), this toothing could have 24 teeth for application to a 24-hour timepiece.

It will also be clear that various alterations and/or improvements evident to those skilled in the art may be made to the embodiment forming the subject of the present description without departing from the scope of the present invention defined by the annexed claims.

What is claimed is:

1. A timepiece comprising:

a timepiece movement;

a calendar mechanism; and means for indicating the sunrise and sunset that take account of seasonal variations, the timepiece movement comprising a minute wheel set, a motion work, an hour indicator member, and an hour wheel set integral in rotation with the hour indicator member and arranged to be driven by the minute wheel set via the motion-work, either at a speed of one revolution in 12 hours, or at a speed of one revolution in 24 hours, the calendar mechanism comprising means for displaying the date arranged to be driven via the hour wheel set, and a month display arranged to be driven by the means for displaying the date, the sunrise and sunset indicating means comprising a sphere replicating the terrestrial globe and a ring mounted concentrically to the sphere and arranged to indicate the position of the earth's terminator, the sphere being arranged to be driven to rotate at a rate of one revolution in 24 hours about a first axis corresponding to the polar axis of the terrestrial globe, and the ring being mounted in order also to be able to pivot relative to the sphere about a second axis intersecting the first axis perpendicularly at the centre of the sphere, the sunset and sunrise indicating means further comprising an annual cam having a profile representative of the tilt of the sun with respect to the equatorial plane, and arranged to be driven in rotation at a rate of one revolution per year, the plane subtended by the ring forming with the first axis an angle equal to the angle of tilt of the sun with respect to the equatorial plane, wherein the timepiece movement comprises a second kinematic chain connecting the hour wheel set to the sphere, so as to drive the sphere at a rate of one revolution in 24 hours, wherein the timepiece movement comprises a manually actuatable time change mechanism arranged to pivot the hour wheel set step-by-step independently of the motion work, and a disengagement mechanism arranged to disengage the second kinematic chain when the time change mechanism pivots the hour wheel set to change from summer time to winter time, or vice versa, so that the sphere can be driven at a rate of one revolution in 24 hours, without being affected by the summer time/winter time correction, and wherein the annual cam is arranged to be driven by the means for displaying the date via a third kinematic chain.

2. The timepiece according to claim 1, wherein the timepiece movement comprises a first hour wheel meshing with the motion work, and a second hour wheel, which is integral with said hour wheel set, and wherein the summer time/winter time correction mechanism comprises a disengageable coupling device arranged to make the first and second hour wheels integral in rotation in one or other of a plurality of predefined relative angular positions, said angular positions being equidistant and spaced apart from each other by an angle corresponding to the distance traveled in one hour by the hour indicator member.

3. The timepiece according to claim 1, wherein the calendar mechanism comprises a mechanism for correcting the month display arranged simultaneously to correct the angular position of the annual cam, such that the month display and the annual cam maintain synchronization after the correction.

4. The timepiece according to claim 1, wherein the means for displaying the date comprise a date wheel and wherein the third kinematic chain comprises a 16-tooth pinion integral with the date wheel, a 48-tooth wheel meshing with the 16-tooth pinion and integral with a 14-tooth intermediate pinion, in turn meshing with a 56-tooth wheel which is integral with the annual cam.

5. The timepiece according to claim 1, wherein the calendar mechanism is an annual or perpetual calendar mechanism.

6. The timepiece according to claim 1, wherein the sunrise and sunset indicating means that takes account of seasonal variations comprise a shell arranged concentrically to the sphere replicating the terrestrial globe, the shell being arranged to demarcate one part of the terrestrial globe where it is night time from another part where it is daytime, and wherein the shell has the general shape of a half-sphere and has a rim of generally circular shape, the rim forming the ring arranged to indicate the position of the earth's terminator.

7. The timepiece according to claim 6, wherein the second axis is substantially collinear with a diameter of the ring, and wherein the shell carries two pivots extending the two ends of the diameter.

8. The timepiece according to claim 7, wherein the rim of the shell has two notches arranged in diametrically opposite positions midway between the two pivots.

9. The timepiece according to claim 1, wherein the timepiece is a watch.

10. A timepiece comprising:

a timepiece movement;

a calendar mechanism; and means for indicating the sunrise and sunset that take account of seasonal variations, the timepiece movement comprising a minute wheel set, a motion work, an hour indicator member, and an hour wheel set integral in rotation with the hour indicator member and arranged to be driven by the minute wheel set via the motion-work either at a speed of one revolution in 12 hours, or at a speed of one revolution in 24 hours, the calendar mechanism comprising means for displaying the date, arranged to be driven via the hour wheel set, and a month display arranged to be driven by the means for displaying the date, the sunrise and sunset indicating means comprising a sphere replicating the terrestrial globe and a ring mounted concentrically to the sphere and arranged to indicate the position of the earth's terminator, the ring being arranged to be driven to rotate at a rate of one revolution in 24 hours about a first axis corresponding to the polar axis of the terrestrial globe, and the ring being mounted in order also to pivot relative to the sphere about a second axis intersecting the first axis perpendicularly at the centre of the sphere, the sunrise and sunset indicating means further comprising an annual cam having a profile representative of the tilt of the sun with respect to the equatorial plane and arranged to be driven in rotation at the rate of one revolution per year, the plane subtended by the ring forming, with the first axis, an angle equal to the tilt angle of the Sun with respect to the equatorial plane, wherein the timepiece movement comprises a second kinematic chain connecting the hour wheel set to the ring, so as to drive the ring at a rate of one revolution in 24 hours, wherein the timepiece movement comprises a manually actuatable time change mechanism arranged to pivot the hour wheel set step-by-step independently of the motion work, and a disengagement mechanism arranged to disengage the second kinematic chain when the time change mechanism pivots the hour wheel set to change from summer time to winter time, or vice versa, such that the ring can be driven at a rate of one revolution in 24 hours without being affected by the summer time/winter time correction, and wherein the annual cam is arranged to be driven by the means for displaying the date via a third kinematic chain.

11. The timepiece according to claim 10, wherein the timepiece movement comprises a first hour wheel meshing with the motion work, and a second hour wheel, which is integral with said hour wheel set, and wherein the summer time/winter time correction mechanism comprises a disengageable coupling device arranged to make the first and second hour wheels integral in rotation in one or other of a plurality of predefined relative angular positions, said angular positions being equidistant and spaced apart from each other by an angle corresponding to the distance traveled in one hour by the hour indicator member.

12. The timepiece according to claim 10, wherein the calendar mechanism comprises a mechanism for correcting the month display arranged simultaneously to correct the angular position of the annual cam, such that the month display and the annual cam maintain synchronization after the correction.

13. The timepiece according to claim 10, wherein the means for displaying the date comprise a date wheel and wherein the third kinematic chain comprises a 16-tooth pinion integral with the date wheel, a 48-tooth wheel meshing with the 16-tooth pinion and integral with a 14-tooth intermediate pinion, in turn meshing with a 56-tooth wheel which is integral with the annual cam.

14. The timepiece according to claim 10, wherein the calendar mechanism is an annual or perpetual calendar mechanism.

15. The timepiece according to claim 10, wherein the sunrise and sunset indicating means that takes account of seasonal variations comprise a shell arranged concentrically to the sphere replicating the terrestrial globe, the shell being arranged to demarcate one part of the terrestrial globe where it is night time from another part where it is daytime, and wherein the shell has the general shape of a half-sphere and has a rim of generally circular shape, the rim forming the ring arranged to indicate the position of the earth's terminator.

16. The timepiece according to claim 15, wherein the second axis is substantially collinear with a diameter of the ring, and wherein the shell carries two pivots extending the two ends of the diameter.

17. The timepiece according to claim 16, wherein the rim of the shell has two notches arranged in diametrically opposite positions midway between the two pivots.

* * * * *